United States Patent [19]

Biagotti

[11] Patent Number: 4,963,223

[45] Date of Patent: Oct. 16, 1990

[54] ROTARY-APPARATUS FOR GLUEING THE OUTER END OF A STICK OF WOUND PAPER MATERIAL

[76] Inventor: Guglielmo Biagotti, Via Di Vorno, 55060 Vorno (LU), Italy

[21] Appl. No.: 333,969

[22] Filed: Apr. 6, 1989

[30] Foreign Application Priority Data

Apr. 8, 1988 [IT] Italy ..... 9380 A/88

[51] Int. Cl.[5] ..... B65H 19/29; B65H 75/28

[52] U.S. Cl. ..... 156/456; 156/457; 242/56 A

[58] Field of Search ..... 156/443, 446, 456, 457, 156/187; 242/56 A, 56 R

[56] References Cited

U.S. PATENT DOCUMENTS

| | | | |
|---|---|---|---|
| 3,505,150 | 4/1970 | Anderson | 156/457 |
| 3,532,572 | 10/1970 | Herman | 156/457 |
| 3,553,055 | 1/1971 | Ganby | 156/187 |
| 3,734,423 | 5/1973 | Kataokra | 242/56 A |
| 4,026,752 | 5/1977 | Hartbauer | 156/457 |
| 4,299,642 | 11/1981 | Berkholtz | 242/56 R |
| 4,475,974 | 10/1984 | Perini | 156/457 |
| 4,581,083 | 4/1986 | Schutz et al. | 156/446 |
| 4,693,766 | 9/1987 | Stauffer | 156/446 |

*Primary Examiner*—Peter Kratz

*Attorney, Agent, or Firm*—Francis J. Bouda

[57] ABSTRACT

Pairs of rollers which receive and make the reel rotate are mounted on a device rotating about a fixed axis, there being associated with said device means designed to keep the axes of the rollers of each pair on a horizontal plane during rotation of the device itself, gluing and rewinding of the strip, and means for imparting to said pairs of rollers an oscillation for unloading the glued reel.

11 Claims, 8 Drawing Sheets

III
B2
53
27
131
11
57
231
27X
B1
211
171
C
155
13
143
153≡173
151
9
133
181
163
191
161
182
162
211
r
185
13
183
R
195
27X
12B≡12
193
183
185
53
III

ROTARY-APPARATUS FOR GLUEING THE OUTER END OF A STICK OF WOUND PAPER MATERIAL

The invention relates to an apparatus for gluing the end portion of the strip of paper material of rolls, i.e. reels, comprising at least one pair of rollers, constrained to rotate in the same direction and with the same speed of rotation, for receiving and making the reel rotate, stopping its rotation and supporting it during the subsequent operations, conveyor means for supporting said pair of support rollers and displacing them from the position for receiving the reel and for unwinding the portion, to the position for gluing the portion and from this position to the unloading position; means for making the or each pair of support rollers rotate until the portion of the reel carried on the said rollers is unwound; blown-air means for causing opening of the portion; surfaces for accommodating the open portion, adjacent to the or to each pair of support rollers, with which surfaces vacuum means for holding said open portion are associated; and means for dispensing the glue on the unwound portion.

In a known apparatus of this type (U.S. Pat. No. 4,475,974), a chain conveyor carries a series of pairs of rollers designed to receive the reel to be glued, which rollers are made to pass underneath a dispensing slide from which the reels wound by a machine arranged upstream are supplied, in order to receive said reels, unwind the free portion therefrom and then convey them underneath a glue dispensing device for gluing said free portion thereof. This apparatus has some drawbacks. In particular, the use of a chain for supporting the rollers accommodating the reels means that the apparatus has large dimensions. Furthermore, on account of their large number and type of anchorage to the chain, the distance between the axes of the rollers of each pair can be adjusted only with difficulty. This gives rise to problems as regards the production of reels with widely varying diameters, for which reels said distance between the axes must be adjusted.

The linear design of this machine also creates problems with regard to unwinding the free portion of the reels. In fact, air suction by the vacuum means associated with the surfaces accommodating the open portion becomes difficult.

The subject of the present invention is an apparatus which does not have the abovementioned disadvantages and which, in addition, is able to reach higher levels of productivity.

Substantially, according to the invention, in an apparatus of the abovementioned type, said pair or said pairs of rollers are mounted on a device rotating about a fixed axis, there being associated with said device means designed to keep the axes of the rollers of each pair on a horizontal plane during rotation of the device itself, and means for imparting to said pair or said pairs of rollers an oscillation for unloading the glued reel.

Two pairs of rollers may be arranged on the said device.

The device may comprise: two flanks, at least one of which is integral with a crown gear meshing with a toothed wheel from which said device obtains its rotating motion; on each of said flanks, and for each pair of rollers, plates carrying said rollers, a plate for each pair of rollers being integral with a toothed wheel constrained to revolve, with the interposition of an idle wheel, on a corresponding toothed wheel coaxial with the device, said toothed wheel coaxial with the device being constrained to perform only a limited oscillation with respect to its own axis in a predetermined position of the device; cam means and tappets for actuating said oscillation; and means for actuating rotation of said pairs of rollers independently.

A suction box may be associated with the or each pair of rollers, on the upper surface of which suction box, provided with suction openings, the portion of the reel to be glued rests, said suction boxes being in communication with a first annular collector rotating with said device and with a second fixed annular collector connected to a suction line. Said rotating collector is subdivided into two portions corresponding to the two suction boxes.

The said device rotates intermittently so as to bring alternately one of said pairs of rollers into the position for unwinding of the portion and the other pair into the gluing position.

The said device may rotate continuously and at least one part of said blown-air means for detaching the portion of the reel and said means for dispensing the glue in this instance follow said pairs of rollers over a part of their rotational movement; means are provided for actuating the movement of said blown-air means and said glue dispensing means, in synchronism with rotation of said device, with which a dispenser of the roll is also synchronized. In particular, said means for actuating the movement of the blown-air means and glue dispensing means may comprise a first cam with a tappet and a second cam associated with a rocker arm, said glue dispensing means and said blown-air means being carried by articulated-quadrilateral systems kinematically connected to said tappet and said rocker arm. The said first cam in practice rotates integrally with said device about the same axis of the latter, and said second cam is coaxial with, and rotates integrally with the cam means for oscillation of the pairs of rollers.

The apparatus also comprises advantageously a pair of pressure rollers at the exit of the reels, the distance between which rollers is adjustable and which have different and, if necessary, adjustable tangential speeds for refining the gluing of the reels, which pass between the two rollers and are rotated by the latter and conveyed away.

The invention will be better understood by following the description and the attached drawing, which shows a practical non-limiting example of the invention itself. In the drawing.

Figure 1:
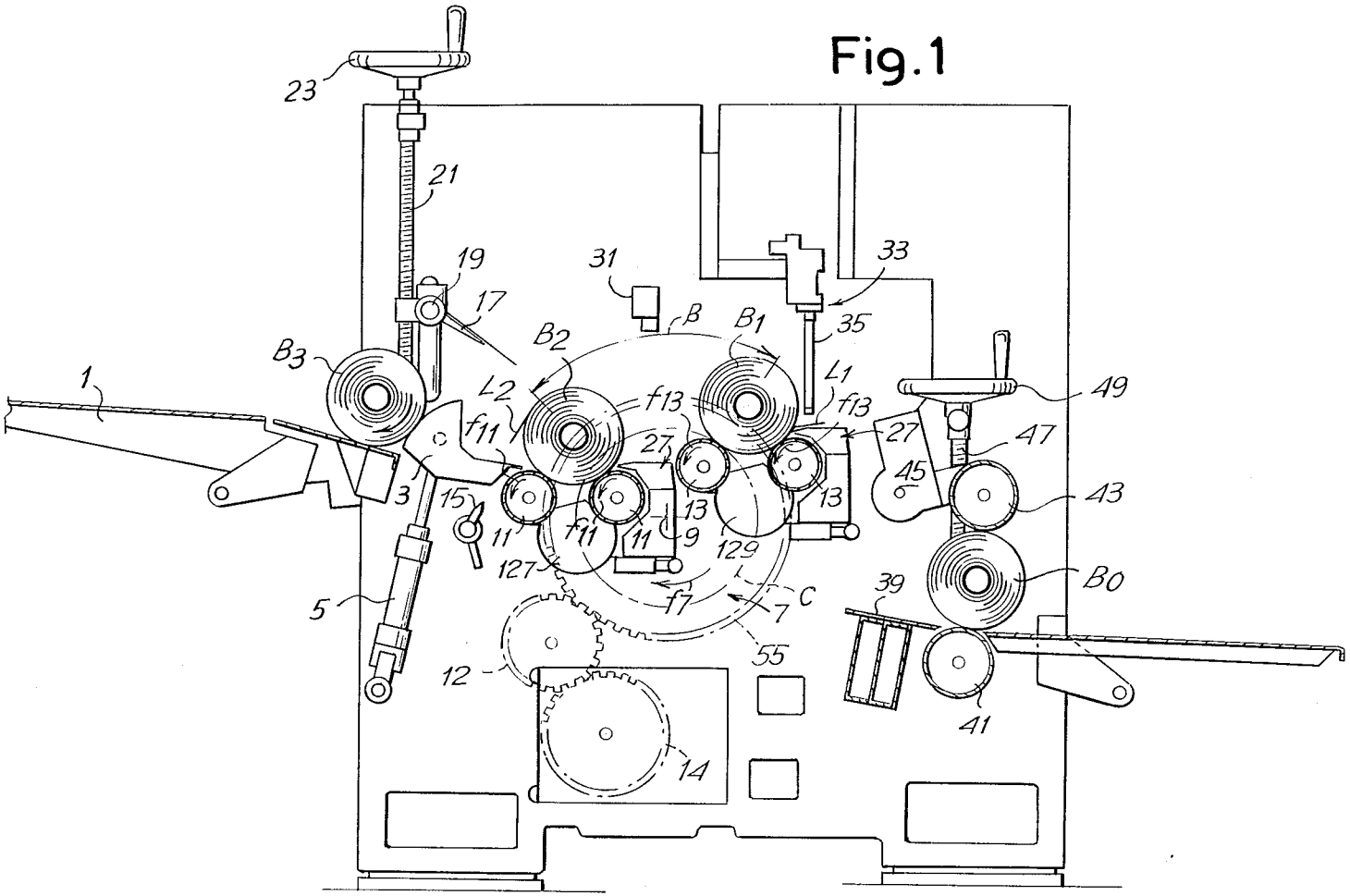
FIG. 1 shows an overall side view of a first embodiment of an apparatus according to the invention.

In accordance with that illustrated in the attached drawing, and with reference initially to FIG. 1, 1 denotes a slide on which the reels coming from a rewinding machine arranged upstream are arranged. A member 3 which oscillates (or is movable always in the same direction), operated by a cylinder/piston system 5, allows one reel at a time to pass to the apparatus for gluing of the end portion of the paper material forming the reel itself. The feed movement may be in advance with respect to the cycle of the other members cooperating with it, so as to minimize the loss of time.

The gluing apparatus comprises a device 7 rotating about a horizontal axis 9 and supporting two pairs of rollers 11,11 and 13,13 respectively, on which the reels B1, B2, B3 coming from the slide 1 and dispensed by the member 3 are placed. The pairs of rollers 11,11 and 13,13 allow unwinding of the reel portion, transfer of the reel to a glue dispensing station, and gluing of the portion. Advantageously, at least one of the rollers of each pair is adjustable, so that the distance between the axes of the rollers of the same pair can be adjusted, so that reels with a different diameter can be handled.

The device 7 is capable of performing an intermittent rotating movement in the direction of the arrow f7 by means of a motor unit 12, 14, described in more detail below, and causes the displacement of the pairs of rollers 11,11 and 13,13 from one to the other of the positions shown in FIG. 1. In the position assumed by the rollers 11,11, two nozzles 15, 17 are arranged, the second of which is mounted on a support 19 movable vertically and adjustable in terms of its position by means of an endless screw 21 and an adjustment handwheel 23. Said nozzles 15, 17 are oriented towards the reel B2 resting on the rollers 11,11 arranged in the position for receving the reel itself from the slide 1 and generate an air current having the function of unwinding the free portion of the reel B2, as described below. Adjustment of the position of the nozzle 17 allows the processing even of reels with widely varying diameters.

In the position shown in FIG. 1, the device 7 is momentarily at a standstill, while the rollers 11,11 rotate in the direction f11 by means of actuating members described in detail below. At the same time, the air stream of the nozzles 15, 17 causes unwinding of the free portion L2 of the reel B2 located on the rollers 11,11. Simultaneous rotation of the reel B2, performed by the rollers 11,11 on which it rests, causes the free portion L2, partially unwound, to be positioned on the surface 25 of a suction box 27 supported by a carrying structure 27X. The surface 25 is provided with suction openings 26 communicating with the inside of the suction box 27. Since a vacuum exists inside the box 27 during this phase, the portion L2 adheres to the surface 25. It is also possible to provide as an alternative a blowing action using a nozzle which is able to follow the portion along its path between the two stations, retracting during its return travel. Rotation of the rollers 11,11 continues until the edge of the portion L2 reaches a given position with respect to the surface 25, reaching of this position being detected by a sensor 31 arranged in a suitable position with respect to the device 7. The sensor 31 (electric, pneumatic or other type) which starts its monitoring operation when the portion L2 comes to rest on the surface 25, causes the rollers 11,11 to stop rotating as soon as it has detected the presence of the portion L2 in the predetermined position. At this point, unwinding of the portion L2 is completed.

While the pair of rollers 11,11 is located in the vicinity of the nozzles 15, 17, the oscillating member 3 and the sensor 31—so as to receive the reel supplied from the slide 1 and unwind the free portion L2 therefrom—, the second pair of rollers 13,13 is located in the vicinity of a gluing group 33, of a type known per se, provided with a glue dispenser 35 capable of performing a movement parallel to the axis of the rollers 13,13 and hence perpendicular to the plane of the figure, opposite a series of holes 26A with very closely arranged openings formed in the structure 27X. The dispenser 35 dispenses, onto the portion L1 of a reel B1 resting on the rollers 13,13, the glue required for gluing the portion L1 to the reel; the surplus glue, beyond the edges of the strip, is collected in 27X. During this phase, the portion L1 adheres to the surface 25 of a suction box 27 similar to that associated with the pair of rollers 11,11, while the rollers 13,13 are at a standstill. After the dispensing of glue onto the portion L1 has been completed, the rollers 13,13 are made to rotate in the direction f13, thus causing rewinding of the free portion L1 and its adhesion to the reel B1, also when the unloading portion is approached. The gluing operations at this point have been completed.

When both the gluing operations performed on the reel B1 and the operations involving unwinding of the portion L2, performed on the reel B2 arranged on the rollers 11,11 have been completed, the device 7 is made to rotate in the direction f7 so as to interchange the positions of the rollers 11,11 and 13,13. During this transfer phase, a suitable mechanism, described below with reference to the subsequent FIGS. 2 to 5, acts in such a way that the axes of the rollers 11,11 are kept, during displacement along the arc, in a horizontal plane, thus preventing the reel B2 carried by the said rollers from falling. The same mechanism also ensures that the axes of the rollers 13,13 are kept in a horizontal plane during transfer from the gluing zone to the zone for receiving the next reel and for unwinding the portion. A system of cams, also described below, ensures, however, that, during this transfer, the rollers 13,13 perform an oscillation about an axis 37 when they are located in the vicinity of an unloading slide 39. In this way, the reel B1 which is located on said rollers 13,13 is unloaded and the free rollers 13,13 are then arranged in the position previously assumed by the rollers 11,11, in the vicinity of the oscillating member 3, in order to receive the next reel B3 located on the slide 1 while waiting to be glued.

Associated with the unloading slide 39, there are pressure rollers 41, 43 between which the reel is made to pass owing to a difference in speed between the two rollers 41,43, as shown for a reel B0 in FIG. 1. The pressure exerted by said pressure rollers 41, 43—as a result of the speed difference and consequent wedging of the roll between them—ensures perfect adhesion of the glued portion. Advantageously, the upper pressure roller 43 is mounted on a movable support 45, the position of which can be adjusted by means of a screw 47 and a handwheel 49 in such a way as to allow, after adjustment, the passage of rolls of varying dimensions. The speed difference may also be adjusted.

Figure 2:
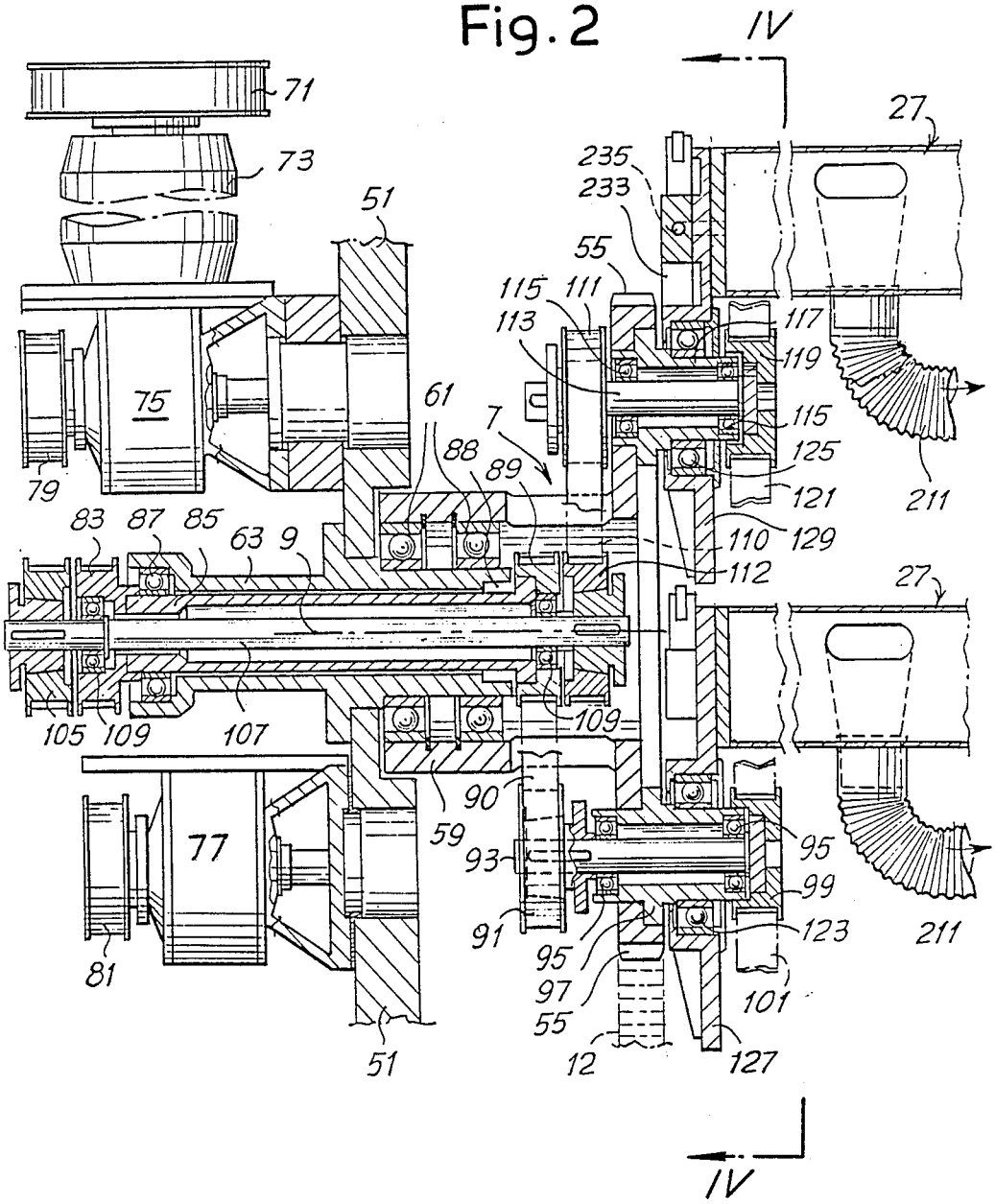
FIGS. 2 and 3 show axial sections, on several planes, of the two flanks of the rotating group of the apparatus shown in FIG. 1.
Figure 3:
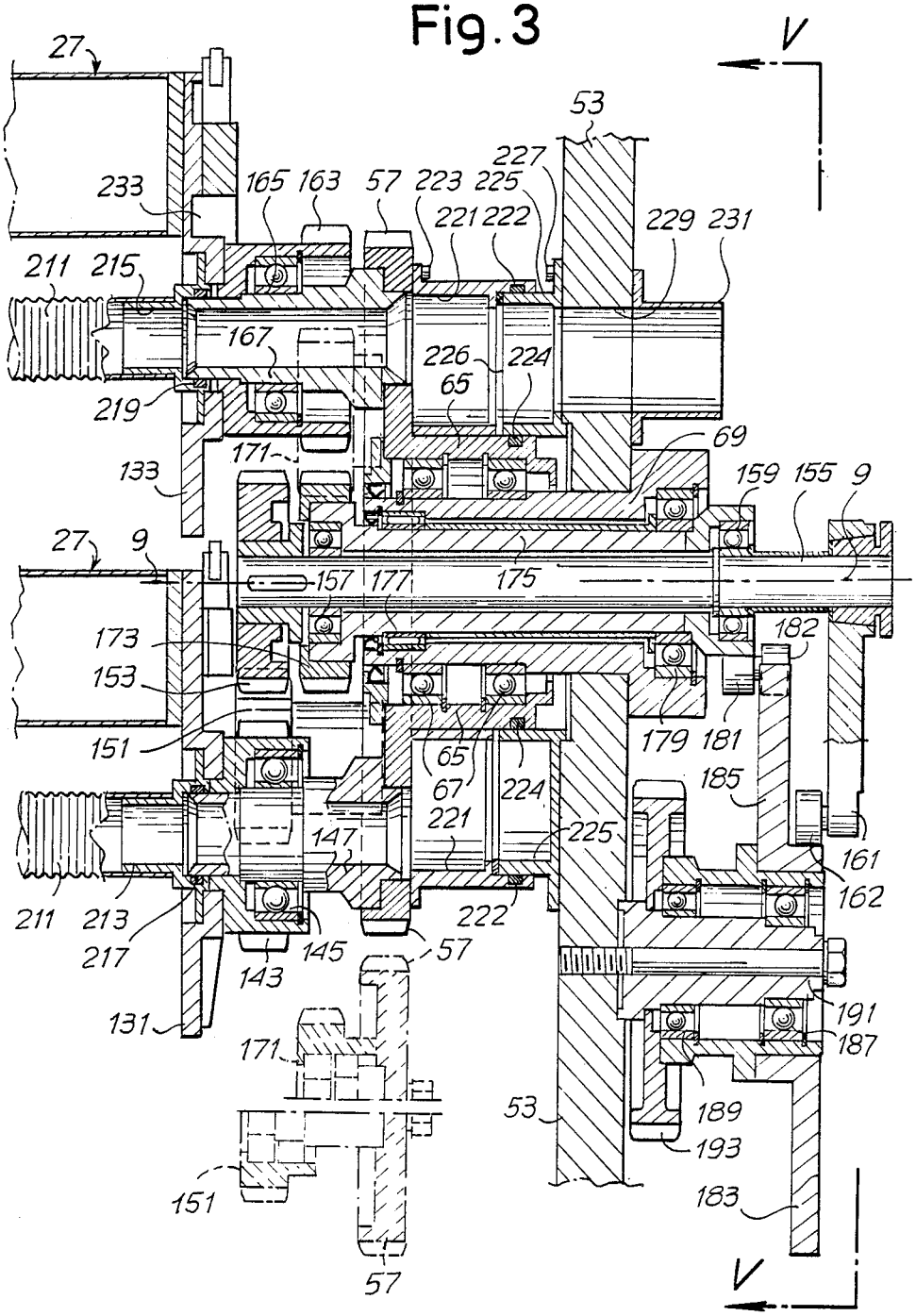
Figure 4:
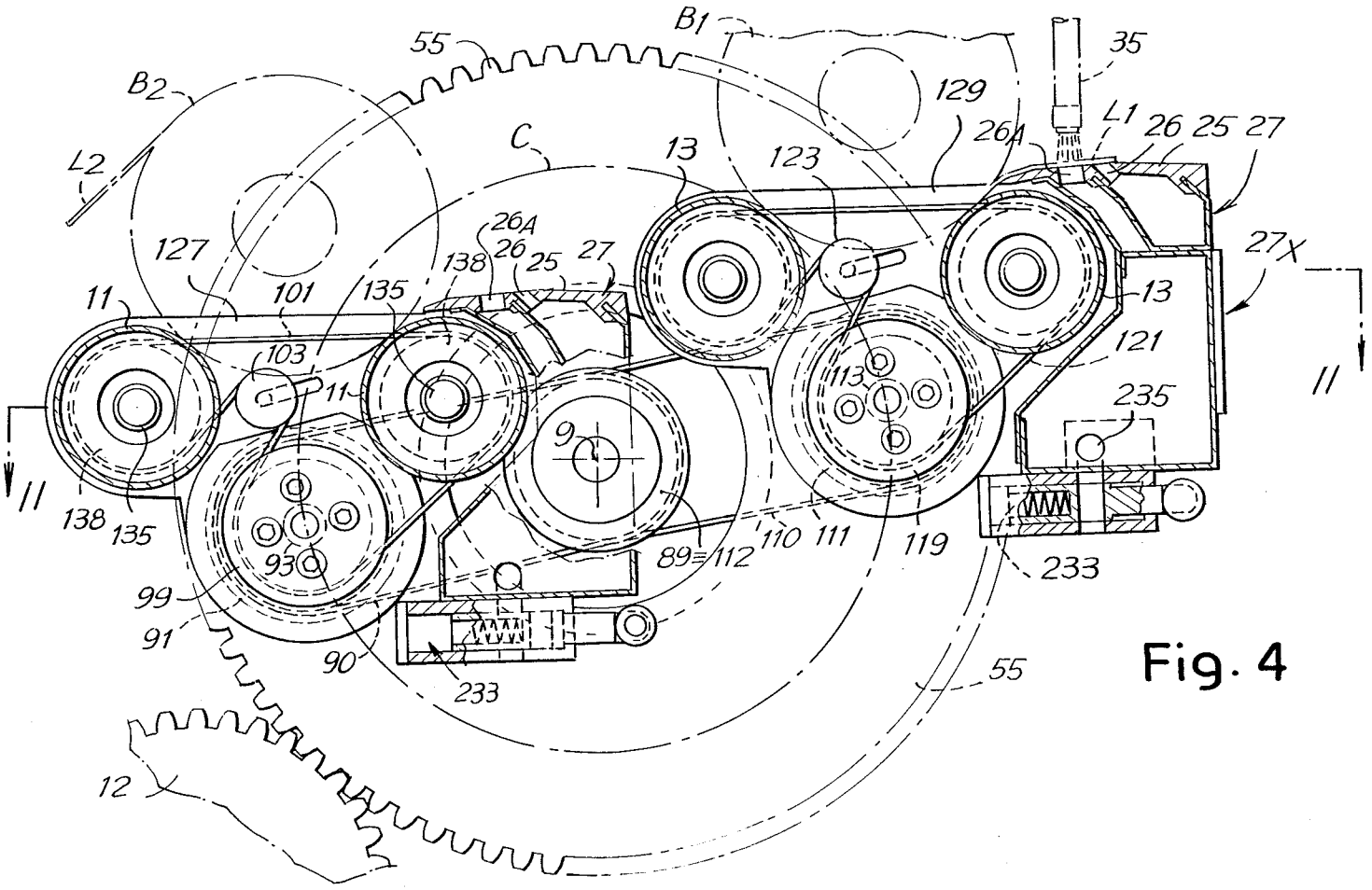
FIGS. 4 and 5 show, respectively, a section along IV—IV of FIG. 2 and a view along V of FIG. 3.
Figure 5:
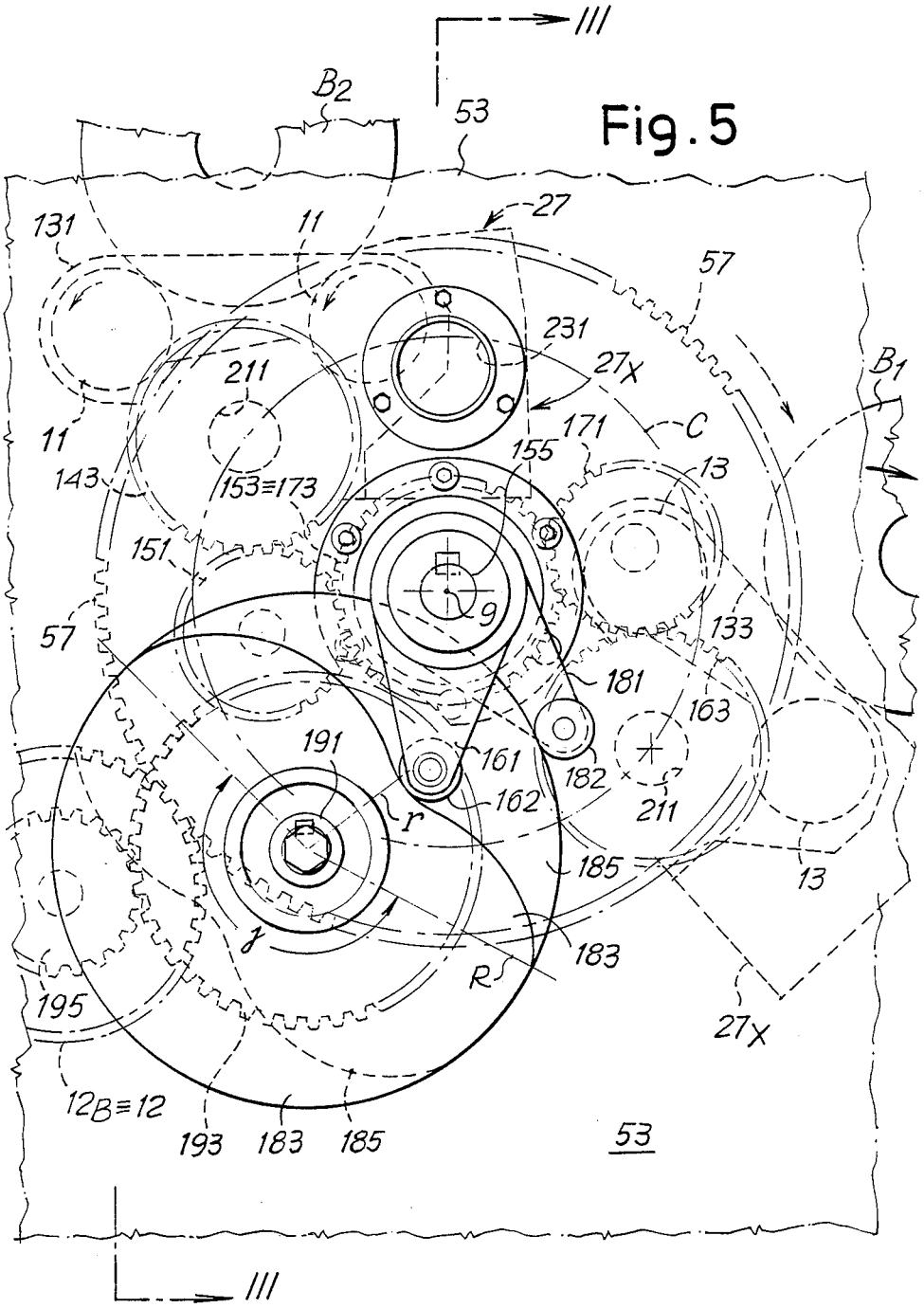

FIGS. 2 to 5 show the mechanisms for the movements of the device 7 and the pairs of rollers 11,11 and 13,13. In particular, FIGS. 2 and 3 show a longitudinal section of the two flanks of the device 7: FIG. 2 shows a section through the flank visible in FIG. 1, while FIG. 3 shows the opposite flank. FIG. 4 shows a section through the device along IV—IV of FIG. 2. In FIG. 5, which is a view along V of FIG. 3, the device 7 is located in the position for unloading the glued reel onto the slide 39.

The device 7 is mounted on a housing, two sides 51 and 53 of which are visible, and comprises substantially two crown gears 55, 57 on the two opposing sides, rotating about the axis 9 and supported on the sides 51 and 53 by means of a hollow shaft 59 (integral with the crown gear 55) supported by bearings 61 on a sleeve 63 integral with the side 51, and by a hollow shaft 65 (integral with the crown gear 57) supported by bearings 67 on a sleeve 69 integral with the side 53.

On the side 51 there are mounted the motor units for the pairs of rollers 11,11 and 13,13. Said motor units comprise, for each pair of rollers, a pulley 71 which is imparted movement by a belt, not shown, and a clutch 73 of the friction-brake type. These two members are shown for one of the two pairs of rollers only. Via the clutch 73, the movement is transmitted, by means of a toothed wheel/endless screw coupling 75, 77, to a pulley 79, 81 for the first and second pair of rollers 11,11 and 13,13, respectively. The movement is obtained from the pulley 81 by means of a belt, not shown, which transmits it to a pulley 83 keyed onto a hollow shaft 85 supported by means of bearings 87,88 inside the sleeve 63 integral with the side 51 of the frame of the apparatus. At the opposite end of the hollow shaft 85 there is keyed a second pulley 89 from which the movement is transmitted, via a belt 90 (FIG. 4), to a further pulley 91 keyed onto a spindle 93 supported by bearings 95 inside a sleeve 97 integral with the crown gear 55. On the shaft 93 there is keyed, at the opposite end to the pulley 91, a further pulley 99 which transmits the movement to the two rollers 11,11 (FIG. 4) via a belt 101 tensioned by a takeup pulley 103; as an alternative to the belt, a gear train may be used.

From the pulley 79, the movement is transmitted, via a belt, not shown, to a pulley 105 keyed onto a shaft 107 coaxial with the hollow shaft 85 and supported inside the latter by means of bearings 109 accommodated inside the pulleys 83 and 89 integral with the hollow shaft 85. At the opposite end to the pulley 105, the shaft 107 has mounted on it a pulley 112, about which there is driven a belt 110 (FIG. 4) which transmits the movement to a pulley 111 keyed onto a spindle 113 supported by bearings 115 inside a sleeve 117 integral with the crown gear 55 and arranged in a position diametrically opposite to the sleeve 97. The spindle 113 carries, at the opposite end to the pulley 111, a further pulley 119; from the pulley 119, the movement is transmitted, by means of a belt 121 (FIG. 4) tensioned by means of a takeup pulley 123, to the two rollers 13,13. This belt transmission may also be replaced by a gear train.

By means of the two series of transmission members described above, the two pairs of rollers 11,11 and 13,13 may be actuated independently of one another upon operation of the sensor 31 and the gluing group 33.

Figure 6:
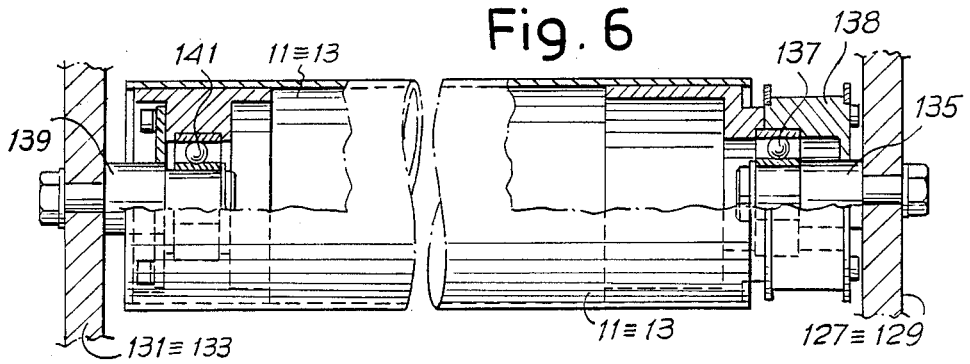
FIG. 6 shows a detail of a roller accommodating the reel being processed.

On the sleeves 97 and 117 there are mounted, by means of bearings 123 and 125 respectively, two plates 127 and 129 on which the rollers 11 and 13, as well as the suction boxes 27 described in greater detail below, are carried. FIG. 6 shows a longitudinal section through one of the rollers 11, 13, from which it can be seen how the latter are carried by the plate 127 or 129, respectively, at one end, and by a similar plate 131 or 133, respectively, at the opposite end, said plate 131 or 133, respectively, being carried, in the manner described below, by the second flank of the device 7. On the plate 127 or 129, respectively, there is mounted a pin 135 which carries a bearing 137 on which the roller 11 or 13, respectively, and the pulley 138 for the toothed belt 101 or 121, respectively, (or corresponding gear train) are mounted. A pin 139 similar to the pin 135, mounted on the plate 131 or 133, respectively, carries a bearing 141 for the opposite end of the roller 11 or 13, respectively.

The plate 131 is integral with a toothed wheel 143 carried by a bearing 145 mounted on a sleeve 147 in turn carried by the crown gear 57 and rigidly joined thereto by means of screws 149. The toothed wheel 143 meshes with an idle wheel 151 (visible in particular in FIG. 5) which in turn meshes with a toothed wheel 153 coaxial with the crown gear 57 and therefore with the device 7. The toothed wheel 153 is keyed onto a shaft 155 supported by bearings 157, 159, at the opposite end of which there is rigidly mounted the arm 161 of a rocker of a cam and rocker system which will be described in greater detail below and which serves to impart to the corresponding rollers 11,11 the angular movement for unloading the glued reel. The shaft 155 is normally prevented from rotating and therefore keeps the corresponding toothed wheel 153 fixed on the axis 9.

In a similar manner, the plate 133 is integral with a toothed wheel 163 supported by a bearing 165 mounted on a sleeve 167 in turn carried by the crown gear 57 and rigidly joined thereto. The toothed wheel 163 meshes with an idle wheel 171 which in turn meshes with a toothed wheel 173 mounted on a hollow shaft 175 coaxial with the shaft 155 and supported by bearings 177, 179 mounted inside the sleeve 69 already mentioned. At the other end of the shaft 175 there is rigidly mounted the arm 181 of a rocker capable of imparting to the rollers 13,13 the angular movement for unloading the glued reel. Similarly to that stated with reference to the shaft 155, the shaft 175 is also normally fixed and prevents rotation of the corresponding toothed wheel 173 about the axis 9.

With the arrangement described above, when the crown gears 55, 57 are made to rotate about the axis 9 of the device 7, the axes of the pulleys 91,99 and 111,119 move along the circumference C shown in FIG. 4, the center of which is located on the axis 9. The plates 127, 131 and 129, 133, supported on the same axis of said pulleys, consequently move along a circular path, the center of which is located on the axis 9 of the device 7. Nevertheless, the system of toothed wheels 143,151,153 and 163,171,173 imparts to the plates 127,131 and 129,133 and to the members connected thereto (box 27 and other) a rotary movement about the axes of the shafts 93, 113 such that, under normal conditions—i.e. for as long as the toothed wheels 153 and 173 are unable to rotate about their axis 9—the abovementioned plates are displaced, but do not rotate, so that the axes of the rollers 11,11 and 13,13 remain, during the rotation of the device 7, on a horizontal plane, preventing the reel resting on the said rollers from falling.

The rocker arms 161, 181, provided with a wheel 162 and 182, respectively, cooperate with a double cam 183, 185, as is shown in particular in FIG. 5. The cam 183, 185 is supported by two bearings 187, 189 mounted on a fixed pin 191 integral with the side 53 of the frame of the machine. A toothed wheel 193, integral with the double cam 183, 185, receives the movement from a pinion 195 (as will be described in greater detail with reference to FIG. 7), rotation of which is synchronized with that of the two crown gears 55, 57 and hence of the entire device 7.

Each portion of said double cam has a profile with a constant radius R over an arc (gamma) and a radius variable from R to a minimum radius r over the complementary arc. In FIG. 5, the wheel 162 of the rocker arm 161 is in contact with the portion 183 of the double cam at a point of the arc with the constant radius R, while the wheel 182 of the rocker arm 181 is in contact with the portion 185 of the double cam at the point where profile of the latter has the minimum radius r. When the wheel 162 or 182, of the rocker arm 161 or 181, respectively, is located on the part of the profile with a radius R, the corresponding pair of rollers, 11,11 and 13,13, respectively, remains in the horizontal position during rotation of the device 7. Vice versa, when the wheel 161 or 181, respectively, of the rocker arm travels over the arc of the profile with a radius variable from R to r and vice versa, the corresponding shaft 155 or 175, respectively, performs an oscillating movement. This causes, by means of the toothed wheels 153,151,143 or 173,171,163, respectively, an oscillation of the corresponding pair of rollers 11,11 or 13,13, respectively, said oscillation allowing the reel which is resting on the actual rollers to be unloaded. In the example of FIG. 5, the pair of rollers 13,13 is located in the position of maximum oscillation with respect to the normal horizontal condition, said position being assumed in the vicinity of the unloading slide 39 (FIG. 1). It should be noted that the interposition of the idle wheel 151 or 171, respectively, allows oscillation of the plates carrying the rollers 11,11 and 13,13 in a clockwise direction for unloading the reel and then an oscillation in the anticlockwise direction for return into the horizontal position. This enables the unloading slide 39 to be arranged in the position indicated in FIG. 1.

Figure 8:
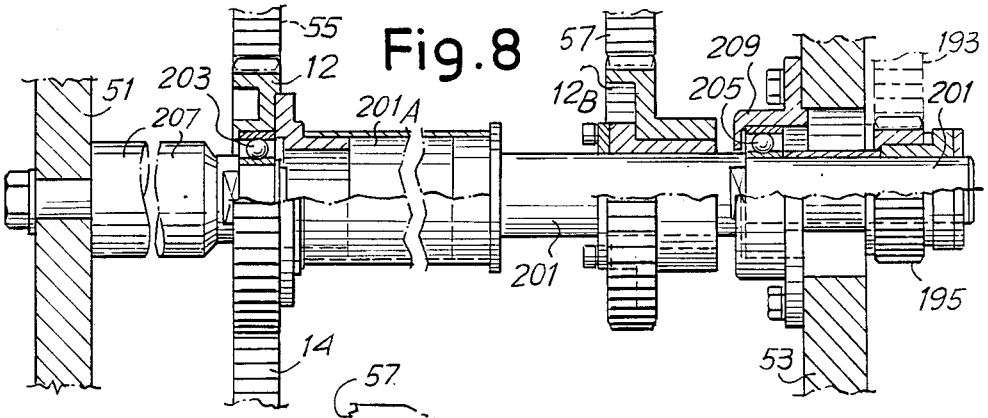
FIGS. 7 and 8 show details of the drive group of the apparatus.
Figure 7:
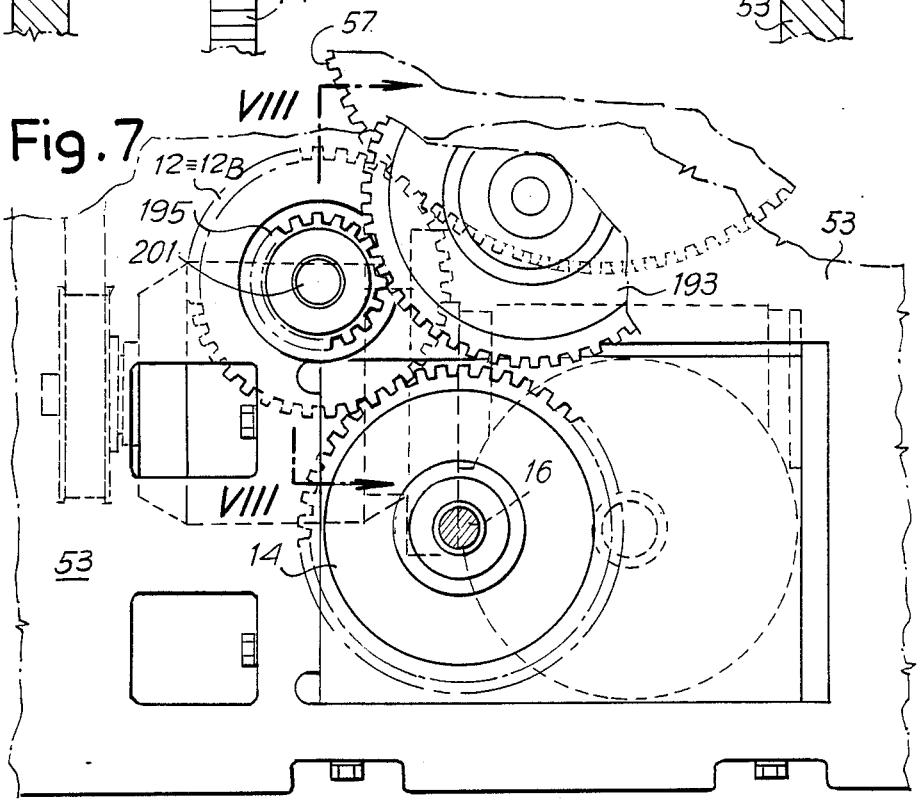

FIGS. 7 and 8 show two details of the system for transmitting the movement to the device 7, FIG. 8 being a cross-section along VIII—VIII of FIG. 7. The toothed wheel 14 obtains movement from a drive shaft 16 and meshes with the toothed wheel 12 keyed onto a shaft 201, having a tubular central portion 201A supported at the two ends by two bearings 203, 205, the first of which is mounted on a pin 207 integral with the side 51 of the frame of the apparatus, while the second one is accommodated in a seat 209 applied to the side 53 of the frame itself. A further toothed wheel 12B is keyed onto the shaft 201, the two toothed wheels 12, 12B meshing with the two crown gears 55 and 57, respectively. The shaft 201 extends beyond the support bearing 205 and projects from the side 53 of the frame so as to carry, at this end, the pinion 195 which supplies the movement to the double cam 181,183.

The suction boxes 27 are connected to flexible tubes 211 (FIG. 3) engaging over flanged connectors 213, 215 mounted on the plates 131 and 133, respectively. Said flanged connectors 213, 215 are in turn fitted onto sleeves 147 and 167 with the interposition of seals 217 and 219, said sleeves and said flanged connectors being capable of performing relative rotational movement about their own axes. The sleeves 147, 167 lead to the interior of an annularly extending collector 221 applied onto the toothed wheel 57 by means of screws 223 and integrally rotating with the latter and hence with the entire device 7. The collector 221 is fitted onto a second annularly extending collector 225 mounted fixedly on the side 53 by means of screws 227 and communicating, by means of an opening 229 in the side 53, with a suction tube 231. A seal 222 is interposed between the two collectors 221 and 225 in relative motion with respect to each other. A further seal 224 is provided on the outside of the collector 225, between the latter and the hollow shaft 65. With this arrangement it is possible to create a vacuum in the interior 29 of the boxes 27 by means of the suction tube 231, both when the device 7 is at a standstill and moving, and hold the free portion of the reel, which said portion which is resting on the pair of rollers 11,11 or 13,13, respectively, adhering to the surface 25 by means of suction through the openings 26.

The suction through the openings 26 is necessary only when the rollers 11,11 and 13,13 are in the two working positions, i.e. where the free portion of the reel is unwound and the glue dispensed, as well as during transfer from the first to the second of said positions. Vice versa, no suction is necessary during the section of path traveled between the glue dispensing position and the position where the portion is unwound. During this section, in fact, it is advantageous if the corresponding openings 26 are not in communication with the suction tube 231 since, with the said openings not being covered by the partially unwound portion of the reel, suction of a large throughput of air through them would occur and, in order to ensure an adequate vacuum inside the other box 27, it would be necessary to give the suction group larger dimensions, resulting in high costs and consumption. It is therefore envisaged that the rotating collector 221 be divided, by means of two radial baffles, not shown, into two portions, each of which communicates with one of the suction tubes 211. Correspondingly, the fixed collector 225 has an opening 226 communicating with the interior of the collector 221 in suitable position and of suitable amplitude.

The suction boxes 27 are supported by the respective support structures 27X, to which there may be applied valves 233 designed to unload the excess glue which may fall outside the width of the paper and within the structure 27X. In FIG. 4 one of the valves 233 associated with the structure 27X, which is in the position for unwinding of the portion, is shown in the closed condition, while one of the valves 233 associated with the other structure 27X, in the position for gluing and rewinding of the portion, is shown in the open position.

To summarize, therefore, when the apparatus is in the position shown in FIG. 1, the rollers 11,11 are made to rotate, in the same direction, by means of the members 77, 81, 83, 85, 89, 91, 93, 99, 101 and at the same time air is blown from the nozzles 15 and 17. The device 7 is at a standstill. Rotation of the rollers 11,11 continues until the sensor 31 detects the presence of the edge of the portion L2 in the predetermined position on the surface 25 of the suction box 27 associated with the rollers 11,11.

At the same time, the glue is dispensed onto the portion L1 of the reel B1 resting on the rollers 13,13. When the glue dispensing group 33 has completed the operation, by means of the members 75, 79, 105, 107, 112, 111, 113, 119, 121 the rollers 13, 13 are made to rotate, in the same direction, so as to cause rewinding of the portion L1 and its adhesion to the reel B1, rewinding being completed between the two rollers 41, 43.

While, during transfer to the gluing position and glue dispensing operation, the respective friction-brake 73 is blocked, after completion of the glue dispensing operation, the brake 73 is disengaged and the clutch is engaged, and rotation of the device 7 about the axis 9 commences. Synchronized therewith, the double cam 183, 185 also rotates, thus causing, in the vicinity of the unloading slide 39 (as shown in FIG. 5), oscillation of the rollers 13,13 for unloading the glued reel, while over the remaining section of the path traveled the axes of the rollers 13,13 and of the rollers 11,11 remain on a horizontal plane. The rotation of the device 7 in question ends when the pair of rollers 13,13 is located in the vicinity of the slide 1 and the member 3 for receiving the next reel B3. The cycle recommences in the manner described above.

Figure 9:
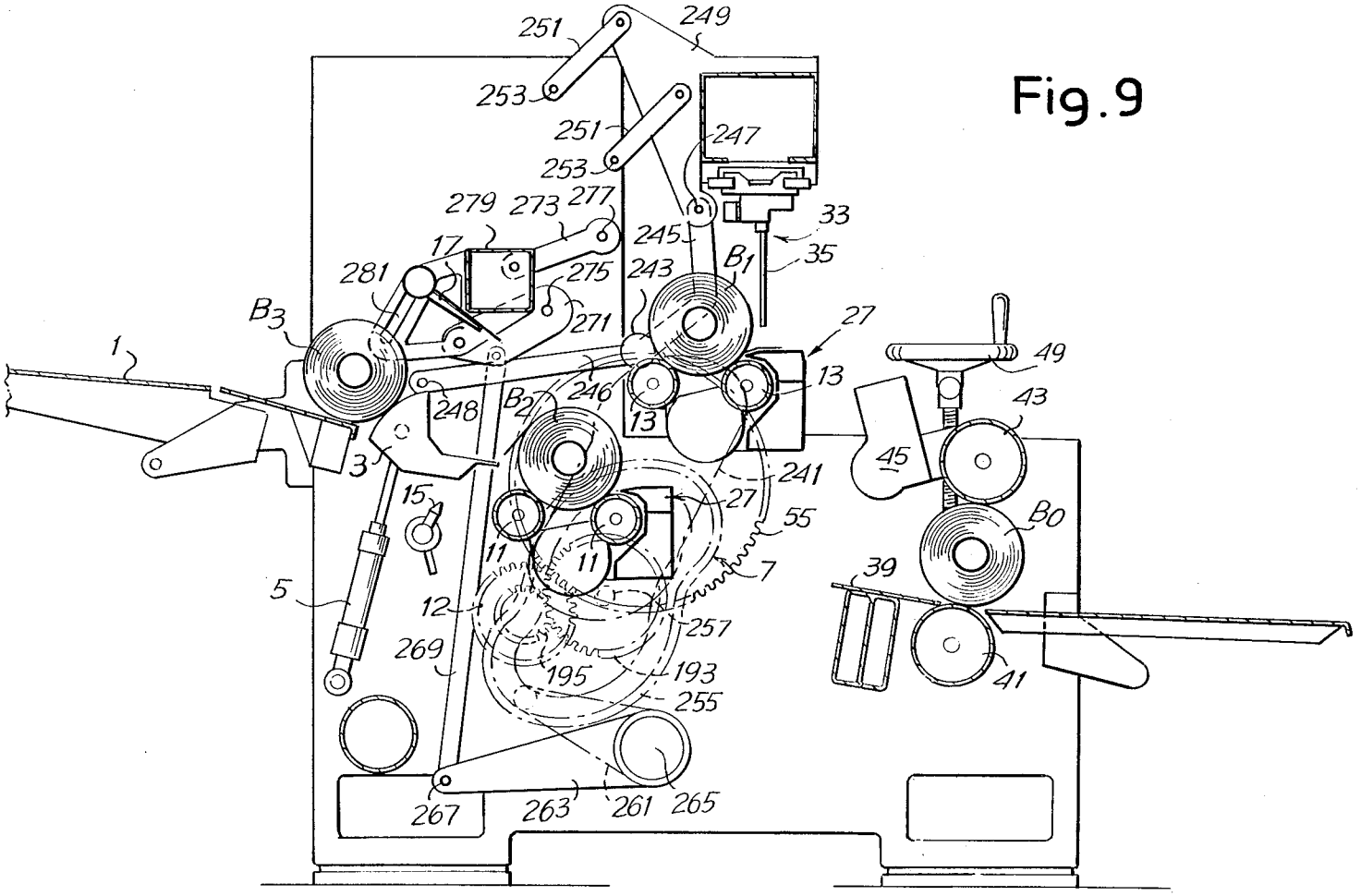
FIGS. 9 and 10 show a side view of a modified embodiment of an apparatus according to the invention in two successive working positions.
Figure 10:
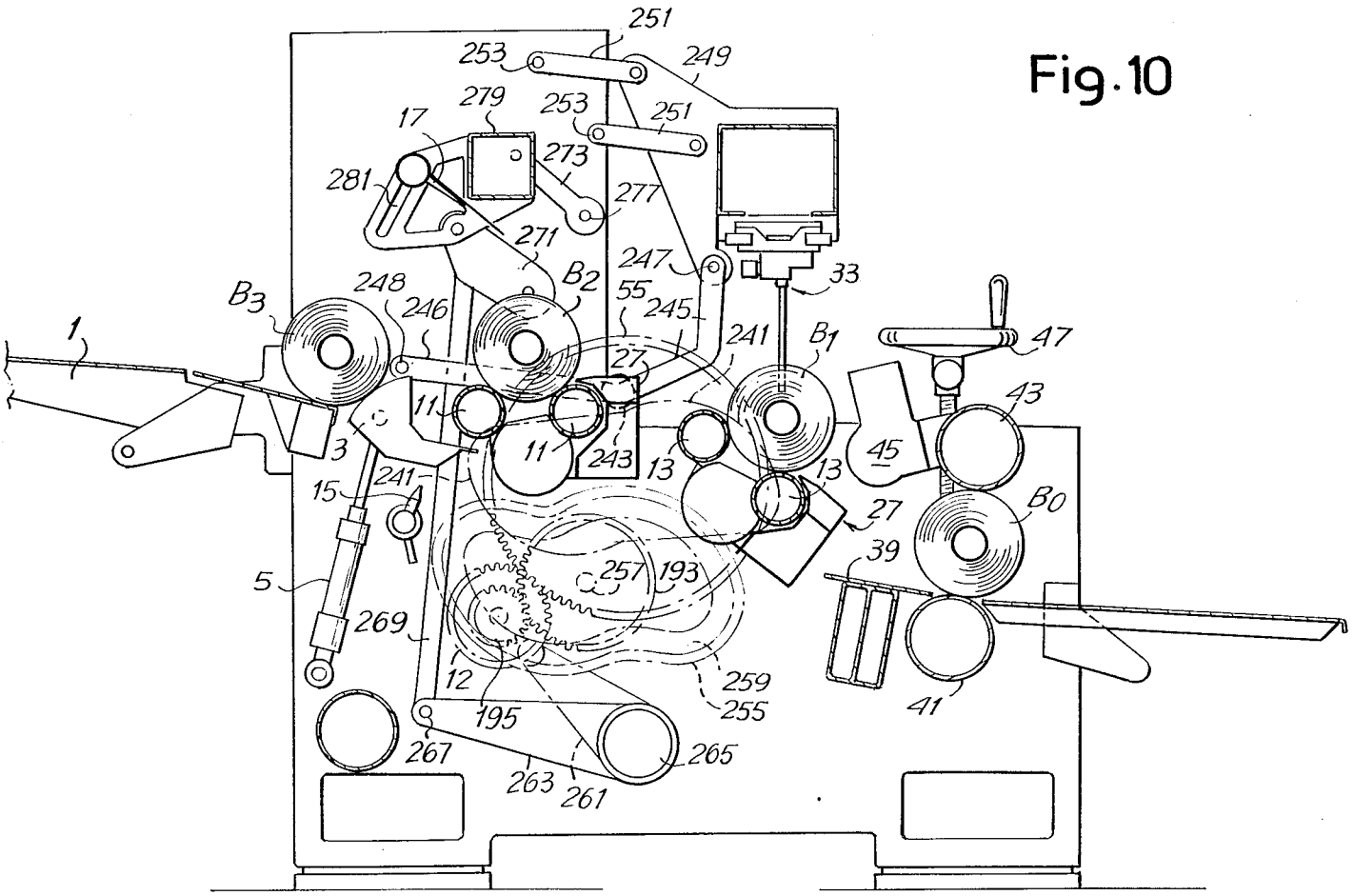

FIGS. 9 and 10 show a modified embodiment of the apparatus described above in two different working positions. Parts corresponding to the apparatus shown in FIG. 1 are indicated by the same reference numbers. In this embodiment, the mechanisms which permit movement of the device 7 and of the relevant rollers 11,11 and 13,13 remain the same as that illustrated for the preceding embodiment, except for the transmission. In addition to the aforementioned mechanisms, in this embodiment there are provided two kinematic systems designed to allow the apparatus carrying the rollers to operate continuously rather than intermittently. As shown in FIGS. 9 and 10, a large cam 241 rotating integrally with said device 7, is keyed onto the axis 9 of the device 7. On the profile of the cam 241 there revolves a wheel 243 of a tappet comprising an elbow arm 245 and a further arm 246 articulated at 248 with the structure of the apparatus. The arm 245 is articulated at 247 with the connecting rod 249 of an articulated quadrilateral formed, in addition to said connecting rod, by two rocker arms 251 articulated at 253 with the structure of the apparatus. The connecting rod 249 extends in such a way as to form the support for the gluing group 33 and is able to oscillate, as a result of rotation of the cam 241, between the two end positions shown in FIG. 9 and in FIG. 10, respectively.

A second cam 255 is keyed onto an axis 257 coinciding with the axis of the double cam 183,185 and made to rotate by means of the same pair of toothed wheels 193,195, such that its rotation is synchronized with that of the device 7 and of the cam 241. Said cam 255 has a channel 259 in which there is guided the wheel of a rocker arm 261,263 articulated at 265 with the structure of the apparatus. At 267 there is articulated with the rocker arm 261,263 a connecting rod 269 which transmits the oscillating movement of said rocker arm to a first rocker arm 271 of an articulated quadrilateral formed by two rocker arms 271,273 articulated with the structure at 275 and 277 respectively, and by a connecting rod 279 which carries the nozzle 17. Said nozzle 17 is adjustable as regards its position on said connecting rod 279 and may be displaced along a slot 281 and fixed in the required position, according to the dimensions of the reels to be processed. The kinematic system 255, 261, 263, 269, 271, 273, 279 enables the nozzle 17 to oscillate between the two end positions, shown in FIGS. 9 and 10, respectively, during rotation of the device 7. The connecting rod 279 also carries the sensor 31 for sensing the rotation of the rollers 11,11 and 13,13 during unwinding of the portion of the reel.

With the arrangement described above it is possible to make the apparatus carrying the rollers operate continuously rather than intermittently. In fact, while the device 7 of the apparatus of FIG. 1 remains at a standstill during unwinding of the portion of the reel B2 and dispensing of the glue on the already unwound portion of the reel B1, rotating only to interchange the positions of the two pairs of rollers 11,11 and 13,13, in the embodiment of FIGS. 9 and 10 the device 7 is constantly rotating, while the nozzle 17 on the one hand and the glue dispensing group 33 on the other hand follow the corresponding pairs of rollers with the relevant reels resting thereon, so as to be able to unwind the free portion and dispense the glue with the device 7 rotating, respectively. The two cams 241 and 255 are profiled in such a way that the nozzle 17 and the glue dispensing group 33 effect the displacement from the position of FIG. 9 to the position of FIG. 10, and the reverse displacement, twice for each complete rotation of the device 7. The device 3 for dispensing the rolls (or other equivalent object) is operated in synchronism with the device 7.

The continuous movement of the device 7 reduces the processing times, thus increasing the productivity, and the dynamic stresses over the entire structure, thereby making operation more gradual and reliable.

It is understood that the drawing shows only one example provided by way of a practical demonstration of the invention, it being possible for the forms and arrangements of the invention to be varied without going outside the scope of the inventive idea of the invention itself. The presence of any reference numbers in the attached claims has the purpose of facilitating reading of the claims with reference to the description and drawing, and does not limit the protective scope of the claims.

I claim:

1. An apparatus for gluing the end portion of the strip of paper material in rolls, comprising at least one pair of rollers, constrained to rotate in the same direction and with the same speed of rotation, for receiving and making the reel rotate, stopping its rotation and supporting it during the subsequent phases, conveyor means for supporting said pair of support rollers and displacing them from the position for receiving the reel and for unwinding the portion, to the position for gluing the portion and from this position to the unloading position; means for making the or each pair of support rollers rotate until the portion of the reel carried on the said rollers is unwound; blown-air means for causing opening of the portion; surfaces for accommodating the open portion, adjacent to the or to each pair of support rollers, with which surfaces pneumatic means for holding said open portion are associated; and means for dispensing the glue on the unwound portion; wherein said pair or said pairs of rollers (11,11; 13,13) are mounted on a device (7) without a chain conveyor, said device rotating about a fixed axis (9), there being associated with said device (7) means designed to keep the axes of the rollers of each pair on a horizontal plane during rotation of the device (7) itself, and means for imparting to said pair or said pairs of rollers an oscillation for unloading the glued reel.

2. The apparatus as claimed in claim 1, wherein two pairs of rollers (11,11; 13;13) are arranged on said device (7).

3. The apparatus as claimed in claim 1, wherein at least one of said flanks is integral with a crown gear (55; 57) meshing with a toothed wheel (12; 12B) from which said device (7) obtains its rotating motion; on each of said flanks, and for each pair of rollers (11,11; 13,13) plates (127,129; 131,133) carrying said rollers (11,11; 13,13), a plate for each pair of rollers being integral with a toothed wheel (143, 163) constrained to revolve, with the interposition of an idle wheel, on a corresponding toothed wheel (153, 173) coaxial with the device (7), said toothed wheel (153, 173) coaxial with the device (7) being constrained to perform only a limited oscillation with respect to its own axis (9) in a predetermined position of the device (7); cam means and tappets (161; 181;

183; 185) for actuating said oscillation; and means (77, 81, 83, 85, 89, 91, 93, 99, 101; 75, 79, 105, 107, 112, 111, 113, 119, 121) for actuating rotation of said pairs of rollers (11,11; 13,13) independently.

4. The apparatus as claimed in claim 1, wherein each pair of rollers (11,11; 13,13) is associated with a suction box (27) on whose upper surface (25) provided with suction openings (26) the portion of the reel to be glued rests, said suction boxes being in communication with a first annular collector (221) rotating with said device (7) and with a second fixed annular collector (225) connected to a suction line (231).

5. The apparatus as claimed in claim 4, wherein said rotating collector is subdivided into two portions corresponding to the two suction boxes (27).

6. The apparatus as claimed in claim 1, having means to rotate said device (7) intermittently so as to bring alternately one of said pairs of rollers into the position for unwinding of the portion and the other pair into the gluing position.

7. The apparatus as claimed in claim 1, wherein said device (7) rotates continuously and at least one part of said blown-air means (15, 17) for detaching the portion of the reel and said means (33, 35) for dispensing the glue follow said pairs of rollers (11,11; 13,13) over a part of their rotational movement; means being provided for actuating the movement of said blown-air means (15, 17) and said glue dispensing means (33, 35), in synchronism with rotation of said device (7), with which a dispenser (3) of the roll is also synchronized.

8. The apparatus as claimed in claim 7, wherein said means for actuating the movement of the blown-air means (15, 17) and glue dispensing means (33, 35) comprise a first cam (241) with a tappet (243, 245, 248) and a second cam (255) associated with a rocker arm (261, 263), said glue dispensing means and said blown-air means being carried by articulated-quadrilateral systems kinematically connected to said tappet and said rocker arm.

9. The apparatus as claimed in claim 8, wherein said first cam (241) rotates integrally with said device (7) about the same axis (9) of the latter, and wherein said second cam (255) is coaxial with, and rotates integrally with the cam means (183. 185) for oscillation of the pairs of rollers (11,11; 13;13).

10. The apparatus as claimed in claim 1, comprising a pair of pressure rollers (41, 43) at the exit of the reels, the distance between which rollers is adjustable.

11. In an apparatus for glueing the end portion of the strip of paper material in rolls, at least one pair of rollers, constrained to rotate in the same direction and with the same speed of rotation, for receiving and making the reel rotate, stopping its rotation and supporting it during the subsequent phases;

two rigid flanks;

said rollers being supported between said flanks on a device without a chain conveyor;

said device supported on a fixed axis between said flanks;

motor means for rotating said device about the fixed axis, and displacing said rollers from a position for receiving the reel and for unwinding the end portion, to a position for glueing the end portion, and from this position to a unloading position;

means which keep the axes of the rollers of each pair of rollers on a horizontal plane during the rotation of the device about the fixed axis;

means for imparting to said pairs of rollers an oscillation with respect to said device for unloading the glued reel in a pre-determined position of the said device during rotation thereof, and subsequently replace the axes of said rollers on the horizontal plane;

means for making each pair of support rollers rotate until the end portion of the reel carried on the said rollers is unwound;

blown-air means for causing opening of the said end portion;

surfaces for accommodating the open end portion, adjacent to the pair of support rollers;

suction means associated with said surfaces for holding said open end portion;

and means for dispensing glue on the unwound portion.

* * * * *